US011029632B2

(12) United States Patent
Kinukawa et al.

(10) Patent No.: US 11,029,632 B2
(45) Date of Patent: Jun. 8, 2021

(54) FIXING APPARATUS PROVIDING A FIXING APPARATUS CAPABLE OF SUPPRESSING A TEMPERATURE RISE IN A NON-SHEET-PASSING PORTION WITHOUT DEGRADING FIRST PRINT OUT TIME

(71) Applicant: CANON KABUSHIKI KAISHA, Tokyo (JP)

(72) Inventors: Tatsuya Kinukawa, Kawasaki (JP); Masashi Tanaka, Kawasaki (JP); Sho Taguchi, Fujisawa (JP); Naofumi Murata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/397,809

(22) Filed: Apr. 29, 2019

(65) Prior Publication Data

US 2019/0339638 A1 Nov. 7, 2019

(30) Foreign Application Priority Data

May 2, 2018 (JP) ..... JP2018-088842

(51) Int. Cl.
*G03G 15/20* (2006.01)

(52) U.S. Cl.
CPC ..... *G03G 15/2057* (2013.01); *G03G 15/2053* (2013.01); *G03G 15/2064* (2013.01)

(58) Field of Classification Search
CPC ..... G03G 15/2053; G03G 15/2057; G03G 15/2064; G03G 2215/2035
See application file for complete search history.

(56) References Cited

U.S. PATENT DOCUMENTS

2014/0138372 A1* 5/2014 Ogura ..... G03G 15/2042 219/216
2015/0227091 A1* 8/2015 Ando ..... G03G 15/55 399/33

FOREIGN PATENT DOCUMENTS

JP 11-084919 A 3/1999

* cited by examiner

*Primary Examiner* — Joseph S Wong
(74) *Attorney, Agent, or Firm* — Canon U.S.A., Inc. I.P. Division

(57) ABSTRACT

A fixing apparatus includes a thermal conductive member that is in contact with a heater and has a thermal conductivity higher than the thermal conductivity of a base material of the heater, and a thermal-resistant member that is disposed between the thermal conductive member and a support member configured to support the heater, a thermal resistance in a thickness direction of the thermal-resistant member being higher than the thermal resistance in the thickness direction of the thermal conductive member.

19 Claims, 9 Drawing Sheets

FIG.7

| HEAT-INSULATING SHEET 100 | | HEAT CONDUCTIVE MEMBER 51 | | MEASUREMENT RESULTS | | |
|---|---|---|---|---|---|---|
| THICKNESS [mm] | THERMAL RESISTANCE [K/W] | THICKNESS [mm] | HEAT CAPACITY [log10(J/K/m$^2$)] | START-UP TIME [s] | NON-SHEET-PASSING PORTION TEMPERATURE RISE [°C] | DETERMINATION |
| 0.03 | 1.5 | 0.3 | 2.86 | 5.7 | 250 | NON-SHEET-PASSING PORTION TEMPERATURE RISE NG |
| | | 1 | 3.39 | 6 | 240 | NON-SHEET-PASSING PORTION TEMPERATURE RISE NG |
| | | 3 | 3.86 | 6.3 | 220 | START-UP TIME NG |
| | | 5 | 4.09 | 6.7 | 200 | START-UP TIME NG |
| | | 10 | 4.39 | 7 | 180 | START-UP TIME NG |
| 0.05 | 2.5 | 0.3 | 2.86 | 5.8 | 240 | NON-SHEET-PASSING PORTION TEMPERATURE RISE NG |
| | | 1 | 3.39 | 6 | 220 | EFFECTIVE |
| | | 3 | 3.86 | 6.3 | 200 | START-UP TIME NG |
| | | 5 | 4.09 | 6.7 | 180 | START-UP TIME NG |
| | | 10 | 4.39 | 7 | 160 | START-UP TIME NG |
| 0.1 | 4.9 | 0.3 | 2.86 | 5.7 | 250 | NON-SHEET-PASSING PORTION TEMPERATURE RISE NG |
| | | 1 | 3.39 | 5.8 | 220 | EFFECTIVE |
| | | 3 | 3.86 | 6 | 210 | EFFECTIVE |
| | | 5 | 4.09 | 6.2 | 200 | START-UP TIME NG |
| | | 10 | 4.39 | 6.5 | 180 | START-UP TIME NG |
| 0.15 | 7.3 | 0.3 | 2.86 | 5.3 | 260 | NON-SHEET-PASSING PORTION TEMPERATURE RISE NG |
| | | 1 | 3.39 | 5.5 | 230 | EFFECTIVE |
| | | 3 | 3.86 | 5.7 | 220 | EFFECTIVE |
| | | 5 | 4.09 | 5.8 | 210 | EFFECTIVE |
| | | 10 | 4.39 | 6.0 | 200 | EFFECTIVE |
| 0.2 | 9.7 | 0.3 | 2.86 | 5.1 | 270 | NON-SHEET-PASSING PORTION TEMPERATURE RISE NG |
| | | 1 | 3.39 | 5.3 | 250 | NON-SHEET-PASSING PORTION TEMPERATURE RISE NG |
| | | 3 | 3.86 | 5.5 | 240 | NON-SHEET-PASSING PORTION TEMPERATURE RISE NG |
| | | 5 | 4.09 | 5.6 | 230 | EFFECTIVE |
| | | 10 | 4.39 | 5.8 | 220 | EFFECTIVE |
| 0.25 | 12.1 | 0.3 | 2.86 | 4.8 | 280 | NON-SHEET-PASSING PORTION TEMPERATURE RISE NG |
| | | 1 | 3.39 | 5 | 260 | NON-SHEET-PASSING PORTION TEMPERATURE RISE NG |
| | | 3 | 3.86 | 5.2 | 250 | NON-SHEET-PASSING PORTION TEMPERATURE RISE NG |
| | | 5 | 4.09 | 5.4 | 240 | NON-SHEET-PASSING PORTION TEMPERATURE RISE NG |
| | | 10 | 4.39 | 5.6 | 230 | EFFECTIVE |
| 0.3 | 14.6 | 10 | 4.39 | 5.4 | 240 | NON-SHEET-PASSING PORTION TEMPERATURE RISE NG |

FIXING APPARATUS PROVIDING A FIXING APPARATUS CAPABLE OF SUPPRESSING A TEMPERATURE RISE IN A NON-SHEET-PASSING PORTION WITHOUT DEGRADING FIRST PRINT OUT TIME

BACKGROUND OF THE DISCLOSURE

Field of the Disclosure

The present disclosure relates to a fixing apparatus for use with an image forming apparatus, such as a copying machine, a printer, or a facsimile, which includes a function of forming an image on a recording material.

Description of the Related Art

An electrophotographic process using toner has heretofore been widely used for image forming apparatuses such as a copying machine, a printer, and a facsimile. As a fixing apparatus for use with such image forming apparatuses, a fixing apparatus having the following structure is known. That is, the fixing apparatus has a structure in which a ceramic heater provided with a pattern of heat generating resistors on a ceramic substrate is used as a heating member and a fixing film which is a rotatable cylindrical endless belt to be heated by the heating member is used. Specifically, a fixing apparatus that employs a film heating process as described below is known. That is, a recording material is brought into pressure contact by a cylindrical fixing film and a pressure roller, and the recording material bearing an image is nipped and conveyed by a pressure-contact portion (fixing nip portion) while being heated, to thereby fix a toner image onto the recording material as a fixed image.

The fixing apparatus that employs the film heating process as described above has a feature that a ceramic heater and a fixing film with a low heat capacity can be used, and thus the temperature of each of the ceramic heater and the fixing film can be increased to a temperature at which the fixing process can be achieved in a short period of time. Therefore, the fixing apparatus that employs the film heating process has advantages such as a reduction in wait time (quick start property: activation on demand), power saving, and suppression of a temperature rise in the main body of an image forming apparatus.

In the fixing apparatus that employs the film heating process, when a recording material (small-size paper) having a width narrower than that of a recording material (large-size paper) having a maximum width for printing is caused to pass in a longitudinal direction, the temperature gradually rises in a non-sheet-passing area (non-sheet-passing portion temperature rise). This temperature rise in the non-sheet-passing portion increases as the speed of printing increases, which is one of the issues for obtaining high productivity.

As one method for suppressing the temperature rise in the non-sheet-passing portion, a method of improving thermal conductivity in the longitudinal direction by disposing a thermal conductive member in contact with the back surface of a heating member such as a ceramic heater is known (Japanese Patent Application Laid-Open No. 11-84919).

However, one of the issues of a fixing apparatus having a structure in which a thermal conductive member is disposed in contact with the back surface of a heating member is an increase in First Print Out Time (FPOT) in an image forming apparatus using such a fixing apparatus. The FPOT refers to a time period since a print signal is transmitted to a printer until a first recording material is discharged from the printer. To shorten the FPOT, it is necessary to use members having a low heat capacity in the fixing apparatus. However, if the thickness of the thermal conductive member is increased to enhance the effect on the temperature rise in the non-sheet-passing portion, the heat capacity increases by that amount, resulting in an increase in heat capacity of the entire fixing apparatus. Accordingly, heat generated from the heater is easily transferred to the thermal conductive member, which leads to a deterioration in the efficiency of heat supply to the recording material.

SUMMARY OF THE DISCLOSURE

The present disclosure has been made in view of the above-described circumstances and is directed to providing a fixing apparatus capable of suppressing a temperature rise in a non-sheet-passing portion without degrading FPOT.

According to an aspect of the present disclosure, a fixing apparatus includes a rotatable cylindrical film, a heater including a first surface in contact with an inner peripheral surface of the film, and a second surface disposed on an opposite side of the first surface, a support member configured to support the heater, and a pressure member configured to form a nip with the heater through the film. The fixing apparatus heats a toner image at the nip, and fixes the toner image onto a recording material. The fixing apparatus also includes a thermal conductive member in contact with the second surface, and a thermal-resistant member disposed between the thermal conductive member and the support member and having a thermal conductivity lower than the thermal conductivity of the thermal conductive member.

Further features and aspects of the present disclosure will become apparent from the following description of example embodiments with reference to the attached drawings.

BRIEF DESCRIPTION OF THE DRAWINGS

FIG. 7 is a table illustrating a list of results of a fixing start-up time and a non-sheet-passing portion temperature rise according to the first example embodiment.

DESCRIPTION OF THE EMBODIMENTS

Example embodiments and various aspects of the present disclosure will be described in detail below.

(Outline of Example Fixing Apparatus)

Figure 1:
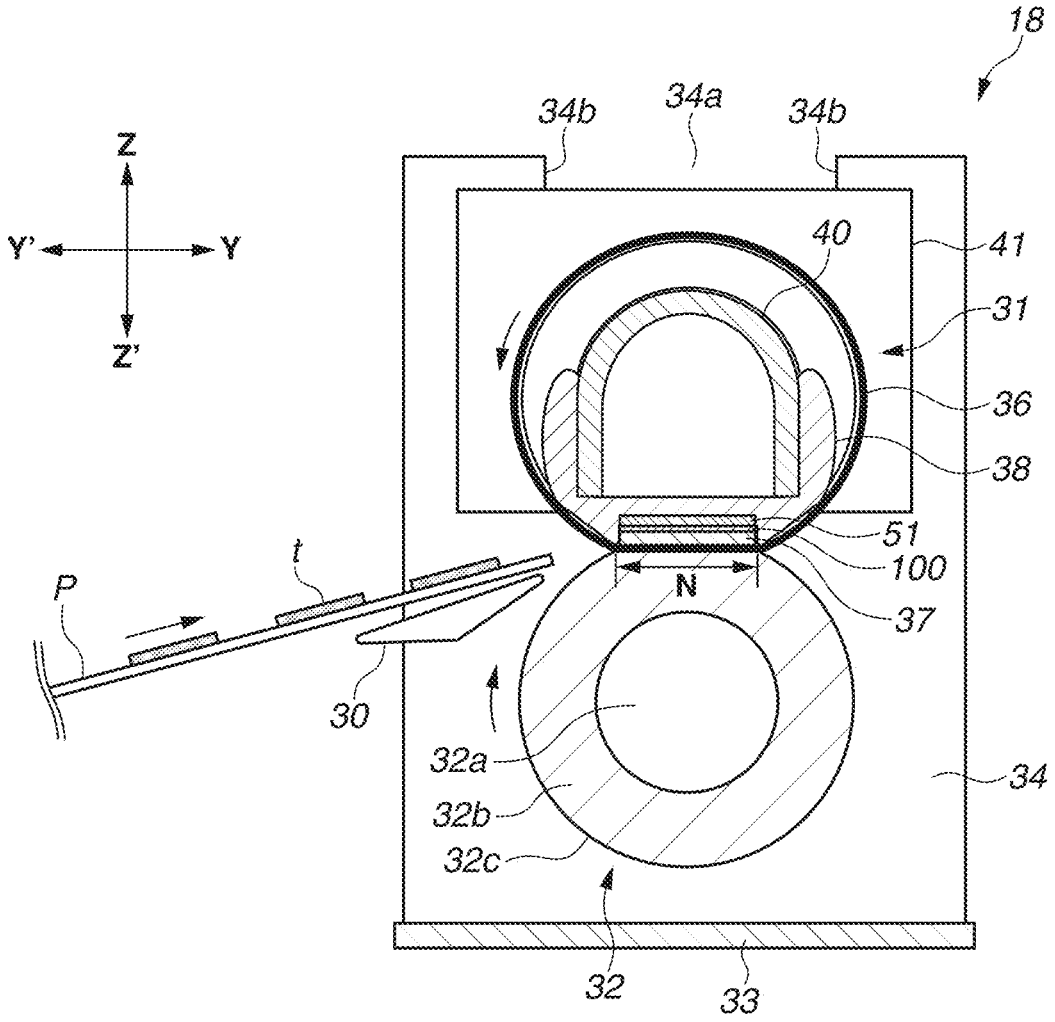
FIG. 1 is a schematic sectional view illustrating a fixing apparatus according to a first example embodiment.
Figure 2:
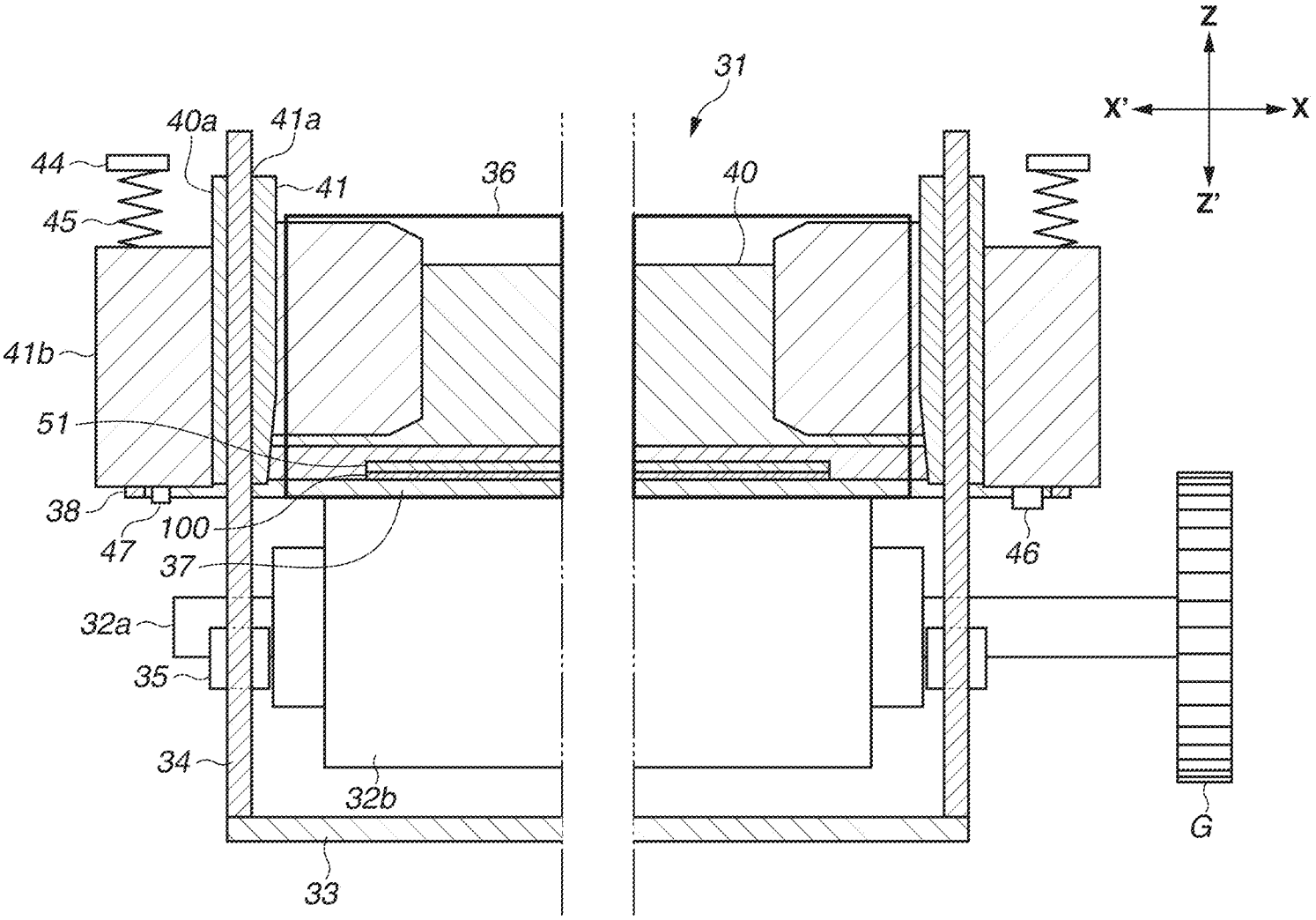
FIG. 2 is a schematic front view illustrating the fixing apparatus according to the first example embodiment.

FIG. 1 is a schematic sectional view illustrating a fixing apparatus 18. FIG. 2 is a schematic front view illustrating the fixing apparatus 18. In the following description of components of the fixing apparatus 18, a longitudinal direction (generatrix direction) corresponds to an X-axis direction in the drawings, a width direction corresponds to a Y-axis direction in which a recording material is conveyed, and a height direction corresponds to a Z-axis direction. An in-plane direction is a direction parallel to a plane formed by the X-axis and the Y-axis, and a thickness direction corresponds to the Z-axis direction.

The fixing apparatus 18 includes a film assembly 31, which is a flexible rotary member including a fixing film 36, and a pressure roller 32 which is a pressure member. The film assembly 31 and the pressure roller 32 are provided substantially in parallel to each other vertically between left and right side plates 34 of an apparatus frame 33.

The pressure roller 32 includes a core metal 32*a* and an elastic layer 32*b* which is formed in a roller shape concentrically integral with the core metal 32*a* and is made of silicone rubber, fluororubber, or the like. On the elastic layer 32*b*, a release layer 32*c* which is made of a perfluoroalkoxy alkane (PFA), polytetrafluoroethylene resin (PTFE), tetrafluoroethylene-hexafluoropropylene copolymer resin (FEP), or the like is formed. In the present example embodiment, the pressure roller 32 having a structure in which the elastic layer 32*b* having a thickness of approximately 3.5 mm is formed on the core metal 32*a*, which is made of stainless steel and has an outer diameter of 11 mm, by injection molding and the PFA resin tube 32C having a thickness of approximately 40 μm is coated on the silicone rubber layer 32*b* is used. The outer diameter of the pressure roller 32 is 18 mm. The hardness of the pressure roller 32 is can be in a range from 40° to 70° with a load of 9.8 N by an ASKER-C hardness meter from the standpoint of securing a fixing nip portion N, endurance, and the like. In the present example embodiment, the hardness of the pressure roller 32 is set to 540. The length of a longitudinal rubber surface of the pressure roller 32 is 226 mm. As illustrated in FIG. 2, the pressure roller 32 is disposed in such a manner that the pressure roller 32 is rotatably supported between the side plates 34 of the apparatus frame 33 through a bearing member 35 at both ends in the longitudinal direction of the core metal 32*a*. A drive gear G is fixed at one end of the core metal 32*a* of the pressure roller 32. A rotary force is transmitted to the drive gear G from a drive mechanism portion (not illustrated), so that the pressure roller 32 is rotationally driven.

The film assembly 31 is illustrated in FIG. 1. The film assembly 31 includes the rotatable cylindrical fixing film 36, a ceramic heater (hereinafter referred to as a heater) 37, a heater holder (support member) 38, a thermal-resistant sheet 100, a thermal conductive member 51, a pressure stay 40, and left and right fixing flanges 41.

The heater 37 is a heating member that heats the fixing film 36. The heater holder 38 guides the fixing film 36 from the inside and supports the heater 37. The thermal-resistant sheet 100 is a thermal-resistant member which is disposed on a surface where the heater 37 is not in contact with the fixing film 36. The thermal conductive member 51 is a heat leveling member that is disposed between the thermal-resistant sheet 100 and the heater holder 38. The film assembly 31 has a structure in which the left and right fixing flanges (regulating members) 41 regulate the movement in the longitudinal direction of the pressure stay 40 and the fixing film 36.

In the present example embodiment, the fixing film 36 has an outer diameter of 18 mm in a non-deformed cylindrical state, and has a multi-layer structure in the thickness direction. The fixing film 36 includes layers, such as a base layer for maintaining the strength of the fixing film 36, and a release layer for reducing the adhesion of soiling on the surface of the fixing film 36. The material of the base layer is required to have a heat resistance because the base layer receives heat from the heater 37. The material of the base layer is also required to have a sufficient strength because the base layer and the heater 37 slide against each other. Accordingly, metal, such as stainless steel or nickel, or a heat resistant resin, such as polyimide, may be used. In the present example embodiment, a polyimide resin is used as the material of the base layer of the fixing film 36, and a carbon-based filler for improving the thermal conductivity and strength is added. Heat generated from the heater 37 is more likely to be transferred to the surface of the pressure roller 32 as the thickness of the base layer decreases, while the strength deteriorates due to a decrease in the thickness of the base layer. For this reason, the thickness of the base layer can be approximately 15 μm to 100 μm. In the present example embodiment, the thickness of the base layer is 50 μm.

As the material of the release layer of the fixing film 36, fluorine resins such as PFA, PTFE, and FEP can be used. In the present example embodiment, the PFA having excellent releasability and heat resistance among the fluorine resins is used. As the release layer, a layer coated with a tube may be used, and a layer having a surface coated with coating solution may also be used. In the present example embodiment, the release layer is molded by a coating method excellent in thin molding. Although heat generated from the heater 37 is more likely to be transferred onto the surface of the fixing film 36 as the thickness of the release layer decreases, the endurance deteriorates if the thickness of the release layer is extremely small. Accordingly, the thickness of the release layer can be approximately 5 μm to 30 μm. In the present example embodiment, the thickness of the release layer is 10 μm. Although not used in the present example embodiment, an elastic layer may be provided between the base layer and the release layer. In this case, silicone rubber, fluororubber, or the like is used as the material of the elastic layer.

As illustrated in FIG. 1, the heater holder 38 is a member having a substantially semicircular trough-like shape in cross section and has rigidity, a heat-resistant property, and a heat-insulating property. The heater holder 38 is formed of a liquid crystal polymer or the like. The heater holder 38 has a function of rotationally guiding the film 36 externally fitted to the heater holder 38, a function of adiabatically holding the heater 37, and a function of serving as an opposed pressure member opposed to the pressure roller 32.

Figure 3:
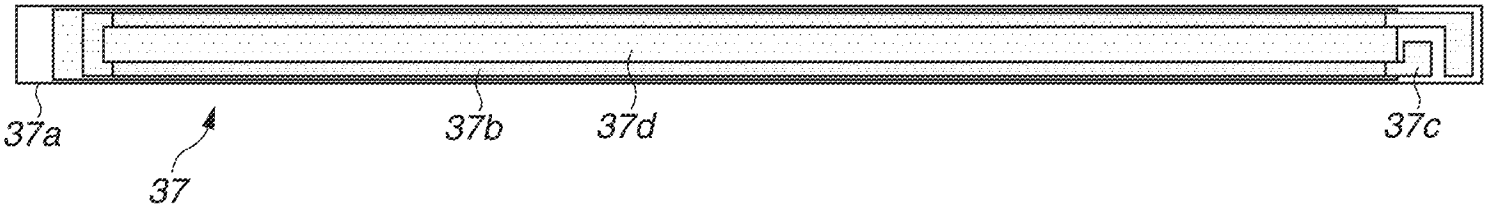
FIG. 3 is an explanatory diagram illustrating an example ceramic heater according to the first example embodiment.

As illustrated in FIG. 3, the heater 37 has a structure in which heat generating resistors 37*b* made of a silver-palladium alloy or the like are formed on a substrate 37*a* made of a ceramic material, such as alumina or aluminum nitride, by screen printing or the like, and an electrode 37*c* made of silver or the like is connected to the heat generating resistors 37*b*. In the present example embodiment, the two heat generating resistors 37*b* are connected in series and have a resistance value of 18Ω. On the heat generating resistors 37*b*, a glass coat 37*d* is formed to protect the heat generating resistors 37*b* and ensure slidability against the fixing film 36. The heater 37 is disposed along the longitudinal direction at a lower surface portion of the heater holder 38.

Figure 4:
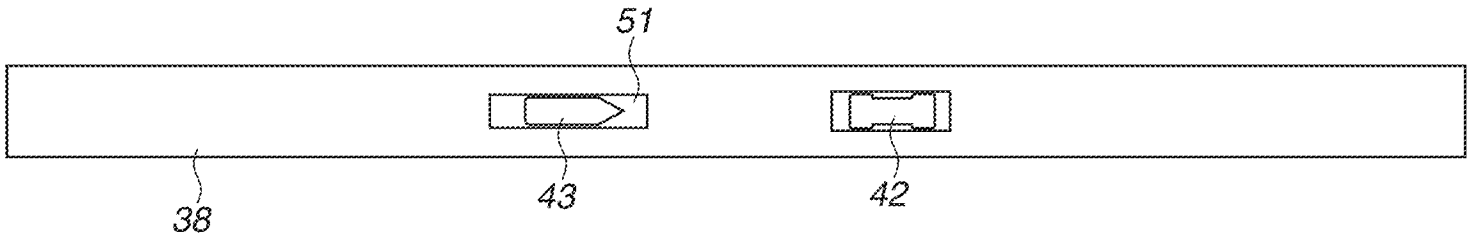
FIG. 4 is an explanatory diagram illustrating an example thermistor and an example temperature fuse according to the first example embodiment.

FIG. 4 is a top view illustrating a state where a safety element and a temperature detection element are mounted on the heater holder 38. The heater holder 38 is provided with through-holes. A thermistor 42 serving as the temperature detection element and a temperature fuse 43 serving as the safety element are disposed in contact with the back surface of the thermal conductive member 51 through the through-holes, respectively. The thermistor 42 has a structure in which a housing is provided with a thermistor element through ceramic paper or the like for stabilizing a contact state with the heater 37, and the housing is coated with an insulating material such as a polyimide tape. The thermistor 42 is an overheat protecting part that senses abnormal heat generation of the heater 37 when the heater 37 causes an abnormal temperature rise, and then blocks a primary circuit. The temperature fuse 43 incorporates a fuse element that is melted at a predetermined temperature in a metal housing having a cylindrical shape. During an abnormal temperature rise, the fuse element is fused to block the circuit. As for the size of the temperature fuse 43 according to the present example embodiment, the length of the metal housing corresponding to a portion in contact with the heater 37 is approximately 10 mm, and the width of the metal housing is approximately 4 mm. The temperature fuse 43 is located on the back surface of the thermal conductive member 51 through thermal conductive grease, thereby preventing a malfunction due to floating of the temperature fuse 43 with respect to the heater 37 from occurring.

When power is supplied to the heat generating resistors 37*b* from a feed portion located at an end of the heater 37, the temperature of the heater 37 rapidly rises. Then, the heater temperature is detected by the thermistor 42, and the supply of power to the heat generating resistors 37*b* from the feed portion is controlled by a control portion (not illustrated) so that the temperature can be controlled at a predetermined temperature.

The pressure stay 40 is a horizontally-long rigid member having a downward U-shaped cross section. In the present example embodiment, stainless steel with a plate thickness of 1.6 mm is used.

As illustrated in FIG. 2, the fixing film 36 is formed on the outside of the heater holder 38 in a state where the heater 37 is attached to the lower surface of the heater holder 38, and the pressure stay 40 is inserted into the heater holder 38. The left and right fixing flanges 41 are respectively fitted to left and right outward extending arm portions of the pressure stay 40. In this manner, the film assembly 31 is assembled.

As illustrated in FIG. 1, the film assembly 31 is disposed substantially in parallel to the upper side of the pressure roller 32 with the side of the film assembly 31 located closer to the heater 37 facing downward, and is disposed between the left and right side plates 34 of the apparatus frame 33. The left and right fixing flanges 41 have a structure in which vertical groove portions 41*a*, which are provided to the left and right fixing flanges 41, respectively, engage with vertical edge portions 34*b* of vertical guide slits 34*a*, which are provided to the left and right side plates 34 of the apparatus frame 33, respectively. In the present example embodiment, a liquid crystal polymer resin is used as the material of the fixing flanges 41.

As illustrated in FIG. 2, pressure springs 45 are provided in a contracted state between pressure arms 44 and pressure portions 41*b* of the left and right fixing flanges 41, respectively. The pressure springs 45 cause the heater 37 to be pressed against the pressure roller 32 by a predetermined pressing force with the fixing film 36 interposed therebetween through the left and right fixing flanges 41, the pressure stay 40, and the heater holder 38. In the present example embodiment, the pressure of the pressure springs 45 is set so that a total pressing force of 160 N is applied by the fixing film 36 and the pressure roller 32. This pressing brings the heater 37 into pressure contact with the pressure roller 32 with the fixing film 36 interposed therebetween against the elasticity of the fixing film 36 and the elasticity of the pressure roller 32, so that the fixing nip portion N of approximately 6 mm is formed. At the fixing nip portion N, the fixing film 36 is sandwiched between the heater 37 and the pressure roller 32 and is deformed along a flat surface (first surface) of the lower surface of the heater 37, and the inner surface of the fixing film 36 is in close contact with the flat surface (first surface) of the lower surface of the heater 37.

Further, a rotary force is transmitted from the drive mechanism portion (not illustrated) to the drive gear G of the pressure roller 32, so that the pressure roller 32 is rotationally driven at a predetermined speed clockwise in FIG. 1. Along with the rotational driving of the pressure roller 32, the rotary force acts on the fixing film 36 due to a frictional force between the pressure roller 32 and the fixing film 36 at the fixing nip portion N. As a result, the fixing film 36 is rotated around the heater holder 38 counterclockwise in FIG. 2 in accordance with the rotation of the pressure roller 32, while the inner surface of the fixing film 36 slides in contact with the lower surface of the heater 37. The inner peripheral surface of the fixing film 36 is coated with heat-resistant grease, thereby ensuring the slidability between the heater 37 and each of the heater holder 38 and the inner peripheral surface of the fixing film 36.

In a state where the fixing film 36 is rotated in accordance with the rotation of the pressure roller 32 and the heater 37 is energized to increase the heater temperature to a predetermined temperature and then the heater temperature is controlled, a recording material P is introduced. An inlet guide 30 has a function of guiding the recording material P so that the recording material P having an unfixed toner image t formed thereon can be accurately guided to the fixing nip portion N.

When the recording material P bearing the unfixed toner image t advances between the fixing film 36 and the pressure roller 32 of the fixing nip portion N, the recording material P is nipped and conveyed together with the fixing film 36 in a state where the toner image bearing surface of the recording material P is in close contact with the outer surface of the fixing film 36. The recording material P is heated by heat from the fixing film 36 which is heated by the heater 37 in the nipping and conveyance process, and the unfixed toner image t formed on the recording material P is heated and pressed onto the recording material P and is then melted and fixed. The recording material P which has passed through the fixing nip portion N is curvature-separated from the surface of the fixing film 36 and is then discharged and conveyed by a discharge roller pair (not illustrated).

The substrate 37*a* of the heater 37 has a rectangular parallelepiped shape having a longitudinal-direction length of 260 mm, a width-direction length of 5.8 mm, and a thickness of 1.0 mm, and is made of alumina. The longitudinal-direction length of each heat generating resistor 37*b* on the heater 37 is 222 mm. Also, when the recording material P of a maximum size (having a width of 216 mm in the present example embodiment) that can be used in an image forming apparatus incorporating the fixing apparatus 18 according to the present example embodiment is used, the heater 37 has a width greater than that of the recording material P so that toner can be uniformly fixed onto the recording material P.

Accordingly, in an area outside the width of the recording material P, heat supplied from the heater 37 is not absorbed by the recording material P and the toner thereon, and the heat is accumulated in the components such as the fixing film 36, the heater 37, and the heater holder 38. When paper is used as the recording material P, in an area outside the recording material P (the area is hereinafter referred to as a non-sheet-passing portion), an excessive temperature rise is likely to occur. This phenomenon is referred to as a "non-sheet-passing portion temperature rise". The temperature at which each member is used has an upper limit. If each member is used at a temperature higher than the upper limit, a problem such as a damage to the member is caused. For this reason, it is necessary to use each member at a temperature lower than or equal to a certain temperature. The "non-sheet-passing portion temperature rise" becomes prominent as the width of the recording material P with respect to the length of each heat generating resistor 37*b* becomes smaller. Accordingly, some measures, such as reduction of an output speed by increasing intervals between recording materials P, are required to reduce the non-sheet-passing portion temperature rise to a certain temperature or lower. Further, if the "non-sheet-passing portion temperature rise" occurs, a thermal stress is applied to the heater 37 due to a temperature difference between a sheet-passing portion and the non-sheet-passing portion, which may cause a damage to the heater 37.

(Arrangement of Example Thermal-Resistant Sheet and Thermal Conductive Member)

In this case, the thermal conductive member 51 having a thermal conductivity higher than the thermal conductivity of the base material of the heater 37 is disposed on the back surface of the heater 37, thereby obtaining a heat leveling effect in which temperature variations in the longitudinal direction are averaged by transferring heat from the non-sheet-passing portion which is at a high temperature to the sheet-passing portion which is at a relatively low temperature. Specifically, the thermal conductive member 51 having a thermal conductivity higher than the thermal conductivity of 32 W/m·K of the base material of the heater 37 formed of aluminum is used. Thus, heat generated outside the recording material P is also transferred to the sheet-passing portion through the thermal conductive member 51 and is then transmitted to the recording material P, so that the heat can be used more efficiently and the "non-sheet-passing portion temperature rise" can be suppressed.

Figure 9:
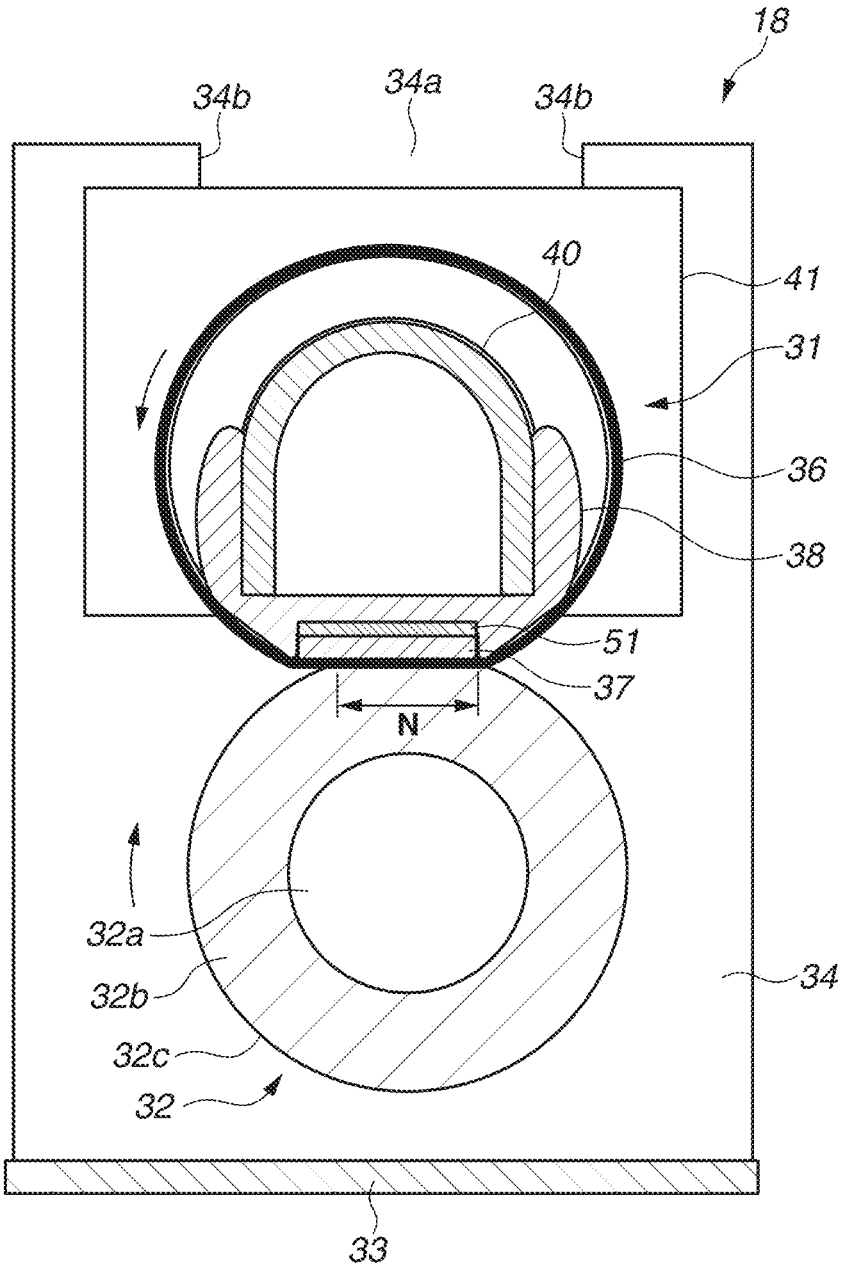
FIG. 9 is a schematic sectional view illustrating a related art fixing apparatus.

A heat leveling member using the thermal conductive member 51 as illustrated in FIG. 9 has heretofore been proposed. In recent years, heat to be accumulated in the non-sheet-passing portion has been increasing along with the speed-up of an image forming apparatus, and thus there is a demand for a higher heat leveling effect. A heat transport amount in the longitudinal direction of the thermal conductive member 51 is determined depending on the product of a thermal conductivity and a cross-sectional area. Therefore, in order to enhance the heat leveling effect, it is effective to increase the heat transport amount by increasing the thickness of the thermal conductive member 51.

However, if the thickness of a material such as a metal plate is increased, the heat capacity also increases in proportion to an increase in thickness. When the heat capacity of the thermal conductive member 51 is increased, heat generated from the heater 37 is lost to the thermal conductive member 51 at start-up of the fixing apparatus 18, which leads to an increase in time required for the temperature to rise to a temperature at which the fixing film 36 can be fixed.

Accordingly, in the present example embodiment, the thermal-resistant sheet 100 is disposed between the heater 37 and the thermal conductive member 51. Thus, the pressing force to be applied from the heater holder 38 is sequentially transmitted to the thermal conductive member 51, the thermal-resistant sheet 100, and the heater 37, so that the heater 37 can be pressed against the pressure roller 32 through the fixing film 36 and a uniform fixing pressure can be applied. On the other hand, in the structure according to the present example embodiment, the thermal resistance value of the thermal-resistant sheet 100 is increased and the heat capacity is decreased to achieve a high-speed start-up, and the non-sheet-passing portion temperature rise can be suppressed by the heat transport amount of the thermal conductive member 51 with a large cross-sectional area during the occurrence of the non-sheet-passing portion temperature rise.

Figure 5:
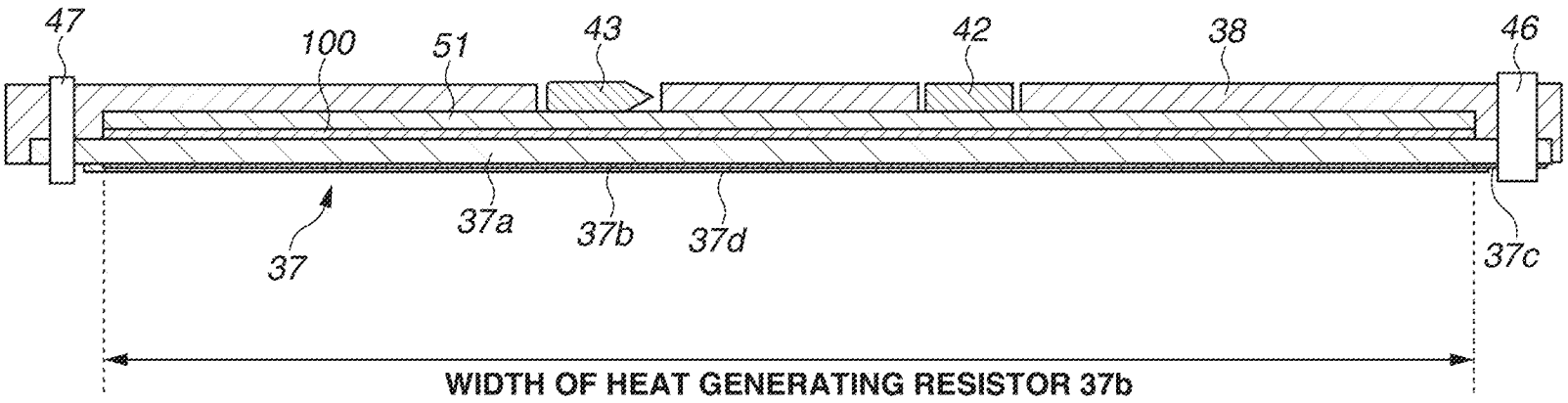
FIG. 5 is an explanatory diagram illustrating an example structure and arrangement of a thermal conductive member and a thermal-resistant sheet according to the first example embodiment.
Figure 6A:
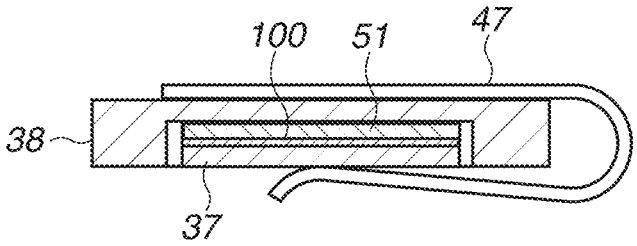
FIGS. 6A and 6B are explanatory diagrams illustrating an example heater clip and a feed connector as heater holding members, respectively, according to the first example embodiment.
Figure 6B:
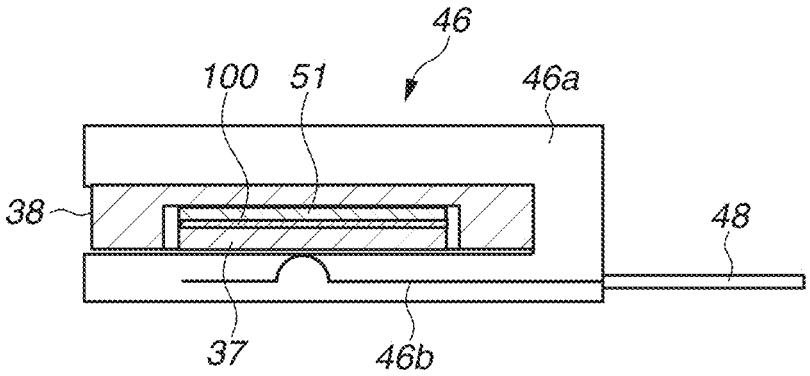

The structure and advantageous effects of the present example embodiment will be described in detail below. The structure and arrangement of the thermal conductive member 51 and the thermal-resistant sheet 100 will be described with reference to FIG. 5 and FIGS. 6A and 6B. FIG. 5 is a schematic sectional view in the longitudinal direction of a part of the film assembly 31 (the illustration of the fixing film 36, the pressure stay 40, and the fixing flange 41 is omitted). FIGS. 6A and 6B are explanatory diagrams illustrating a heater clip 47 and a feed connector 46 as heater holding members, respectively.

As illustrated in FIG. 5, the thermal conductive member 51 contacts a surface (second surface) opposite to the flat surface (first surface) of the lower surface of the heater 37, and the thermal-resistant sheet 100 is disposed on the thermal conductive member 51 and the heater holder 38 is further disposed on the thermal-resistant sheet 100. Thus, in the present example embodiment, the feed connector 46 and the heater clip 47, each of which serves as a holding member provided at an end in the longitudinal direction of the heater holder 38, form a laminated structure including the heater 37, the thermal conductive member 51, the thermal-resistant sheet 100, and the heater holder 38. The thermistor 42 and the temperature fuse 43 are disposed in contact with the back surface of the thermal conductive member 51 through the respective through-holes of the heater holder 38. In the present example embodiment, the thermistor 42 and the temperature fuse 43 contact the thermal conductive member 51, but instead may contact the fixing film 36, for example, in terms of improvement in responsiveness.

In the present example embodiment, the longitudinal-direction length of each of the thermal conductive member 51 and the thermal-resistant sheet 100 is 222 mm, and the width-direction length of each of the thermal conductive member 51 and the thermal-resistant sheet 100 is 5.8 mm. The longitudinal-direction length is set to be equal to the length of each heat generating resistor 37*b* of the heater 37, thereby obtaining a temperature averaging effect without deficiency or excess. The thermal conductivity and thickness of each of the thermal conductive member 51 and the thermal-resistant sheet 100 according to the present example embodiment will be described in detail below.

As illustrated in FIG. 6A, the heater clip 47 formed of a metal plate curved in a U-shape is provided at one end in the longitudinal direction of the heater holder 38. The heater clip 47 holds an end of each of the thermal conductive member 51 and the heater 37 with respect to the heater holder 38 by a spring property of the heater clip 47. Further, the end of the heater 37 that is pressed by the heater clip 47 is movable in the in-plane direction of a heater sliding surface. This prevents an unnecessary stress from being applied to the heater 37 due to thermal expansion of the heater 37.

Accordingly, the heater holder 38, the thermal conductive member 51, the thermal-resistant sheet 100, and the heater 37 are not fixed to each other so as to absorb a difference in thermal expansion and bending caused due to the pressing force. The heater holder 38, the thermal conductive member 51, the thermal-resistant sheet 100, and the heater 37 contact each other by the spring property of the holding member and the pressing force generated by the pressure roller 32.

As illustrated in FIG. 6B, at the other end in the longitudinal direction of the heater holder 38, the feed connector 46 including a housing portion 46*a*, which is formed of a resin with a recessed shape, and a contact terminal 46*b* is formed. The housing portion 46*a* and the contact terminal 46*b* sandwich and hold the thermal conductive member 51, the heater 37, and the heater holder 38, and the contact terminal 46*b* contacts the electrode 37*c* of the heater 37 so as to establish an electrical connection therebetween. In the present example embodiment, the feed connector 46 is used as the heater holding member, but instead the function of feeding power to the heater 37 and the function as the heater holding member may be separately provided. The contact terminal 46*b* is connected to a bundle wire 48, and the bundle wire 48 is connected to an alternate current (AC) power supply and a triac (not illustrated) (gate-controlled semiconductor switch).

In the present example embodiment, Kapton® (DU PONT-TORAY CO., LTD.), which is a polyimide film having a high heat-insulating property, is used as the thermal-resistant sheet 100, and the thermal conductivity is set to 0.16 [W/mK]. The specific heat and the density of the thermal-resistant sheet 100 are 1.16 [kJ/kgK] and 2000 [kg/m$^3$], respectively. Pure aluminum is used as the thermal conductive member 51 and the thermal conductivity is set to 237 [W/mK]. The specific heat and the density of the thermal conductive member 51 are 0.905 [kJ/kgK] and 2688 [kg/m$^3$], respectively. These values are merely examples. The thermal-resistant sheet 100 may have any value as long as the thermal conductivity is less than or equal to 2 [W/mK] so as to achieve high-speed start-up, and the thermal conductive member 51 may have any value as long as the thermal conductivity is greater than or equal to 80 [W/mK] so as to suppress the non-sheet-passing portion temperature rise.

The thermal resistance [K/W] of each of the thermal-resistant sheet 100 and the thermal conductive member 51 is obtained by dividing the thickness of each member by the product of the thermal conductivity and the area in the plane direction. The heat capacity [J/Km$^2$] per unit area in the plane direction is obtained by integrating the specific heat, the density, and the thickness.

The present example embodiment has a feature in that the thermal resistance in the thickness direction of the thermal-resistant sheet 100 is higher than that of the thermal conductive member 51, and the heat capacity in the plane direction of the thermal conductive member 51 is higher than that of the thermal-resistant sheet 100.

When the above-described relationships are satisfied, heat generated from the heater 37 at the start-up can be prevented from being lost to the thermal conductive member 51 due to the high thermal resistance of the thermal-resistant sheet 100. Accordingly, the heat capacity of the thermal conductive member 51 can be increased. Since the heat capacity of the thermal-resistant sheet 100 is low during continuous printing in which the non-sheet-passing portion temperature rise occurs, heat is transmitted to the thermal conductive member 51, so that the non-sheet-passing portion temperature rise can be suppressed by the heat transport amount.

Next, advantageous effects of the present disclosure will be described with reference to FIG. 7. To verify the operation and advantageous effects of the present example embodiment, the thickness of each of the thermal-resistant sheet 100 and the thermal conductive member 51 was set within the range of Table 1, and the fixing start-up time and the non-sheet-passing portion temperature rise were measured by changing the thermal resistance of the thermal-resistant sheet 100 and the heat capacity of the thermal conductive member 51. In a comparative example, a structure in which only the thermal conductive member 51 which is made of pure aluminum and has a thickness of 0.3 mm is disposed on the back surface of the heater 37 as illustrated in FIG. 9 was used, and this structure was compared with the structure according to the present example embodiment. The fixing start-up time is a period from a time when the energization of the heater 37 and the rotation of the pressure roller 32 are started from a room-temperature state to a time when the toner image t formed on the recording material P can be fixed. The non-sheet-passing portion temperature rise is a maximum value of a surface temperature of the pressure roller 32 when 200 A4-size sheets are continuously caused to pass at a sheet passing speed of 30 sheets/minute. In the measurement of the non-sheet-passing portion temperature rise, A4-size thick paper with a grammage of 128 g/m$^2$ was used as evaluation paper, and an infrared thermography manufactured by FLIR Systems, Inc. was used to measure the temperature. The width of A4-size paper is 210 mm, which is shorter by 12 mm (6 mm on one side) than the width of 222 mm of the heat generation member. Accordingly, the non-sheet-passing portion temperature rise occurs on the inside of the heat generating resistors 37*b* of the heater, and the non-sheet-passing portion temperature rise occurs at both end portions on the outside of the A4-size paper. In the present example embodiment, silicone rubber used for the elastic layer of the pressure roller 32 first reaches an upper-limit service temperature, and thus the temperature of the pressure roller 32 was measured.

TABLE 1

| Heat-insulating sheet 100 | | | | Thermal conductive member 51 | | | |
|---|---|---|---|---|---|---|---|
| Material | Thermal conductivity [W/mK] | Thickness [mm] | Thermal resistance [K/W] | Material | Thermal conductivity [W/mK] | Thickness [mm] | Heat capacity [log10 (J/K · m$^2$)] |
| Kapton | 0.16 | 0.03 | 1.5 | pure aluminum | 237 | 0.3 | 2.86 |
| | | 0.05 | 2.9 | | | 1 | 3.39 |
| | | 0.1 | 4.9 | | | 3 | 3.86 |

TABLE 1-continued

| Heat-insulating sheet 100 | | | | Thermal conductive member 51 | | | |
|---|---|---|---|---|---|---|---|
| Material | Thermal conductivity [W/mK] | Thickness [mm] | Thermal resistance [K/W] | Material | Thermal conductivity [W/mK] | Thickness [mm] | Heat capacity [log10 (J/K · m²)] |
| | | 0.15 | 7.3 | | | 5 | 4.09 |
| | | 0.2 | 9.7 | | | 10 | 4.39 |
| | | 0.25 | 12.1 | | | | |
| | | 0.3 | 14.6 | | | | |

As a result, in the comparative example, the fixing start-up time was 6.0 seconds and the maximum temperature of the pressure roller 32 when the temperature rise occurred in the non-sheet-passing portion was 230° C. Based on the results of the comparative example, FIG. 7 illustrates a list of evaluation results of the start-up time and the non-sheet-passing portion temperature rise in combination of settings of the thickness of the thermal-resistant sheet 100 and the thickness of the thermal conductive member 51. When the thickness of the thermal-resistant sheet 100 is 0.03 [mm] and the thermal resistance is 1.5 [K/W], there was no structure in which the start-up time and the temperature rise in the non-sheet-passing portion improved when the thickness of the thermal conductive member 51 is in a range from 0.3 to 10 [mm].

When the thickness of the thermal-resistant sheet 100 is 0.3 [mm] and the thermal resistance is 14.6 [K/W], the heat-insulating performance of the thermal-resistant sheet 100 was too high, and thus an improvement in the effect of suppressing the non-sheet-passing portion temperature rise was not confirmed even when the thickness of the thermal conductive member 51 was set to 10 [mm].

On the other hand, when the thickness of the thermal-resistant sheet 100 is in a range from 0.05 to 0.25 [mm], excellent results for both the start-up time and the temperature rise in the non-sheet-passing portion were obtained by optimizing the thickness of the thermal conductive member 51.

Figure 8:
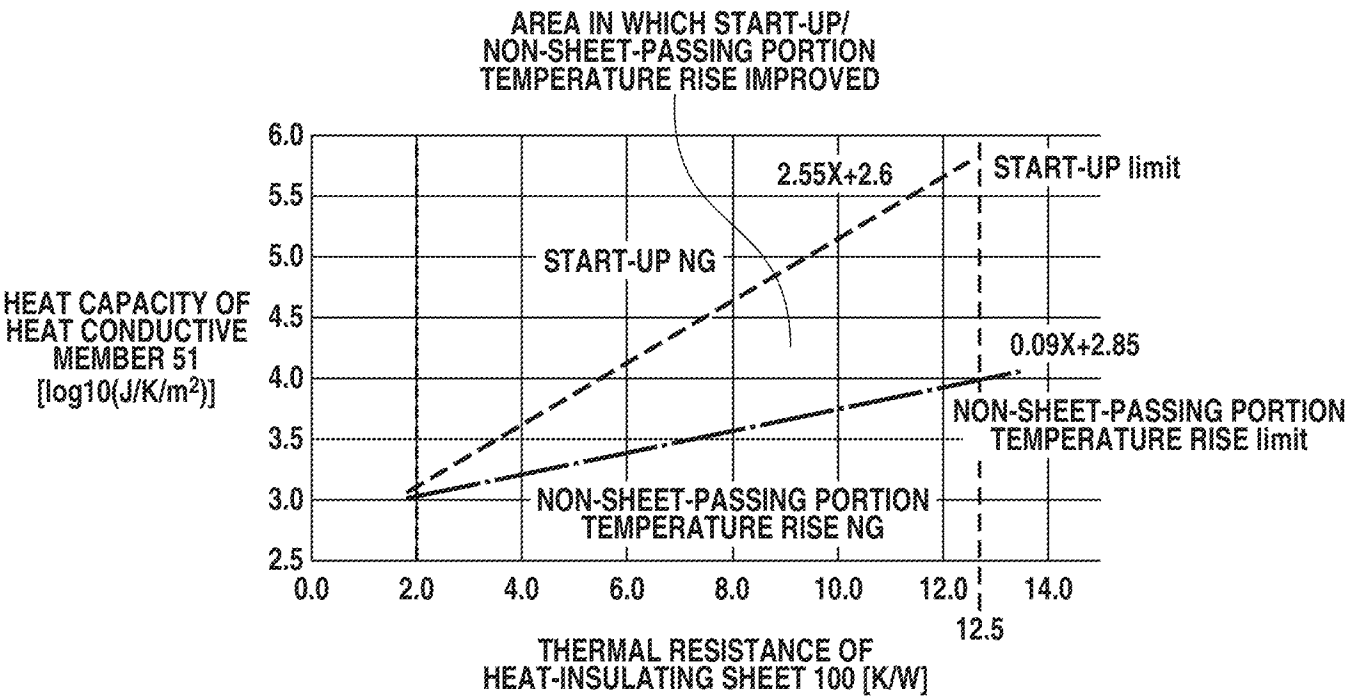
FIG. 8 is a graph illustrating a range in which both a reduction in fixing start-up time and suppression of the non-sheet-passing portion temperature rise are achieved according to the first example embodiment.

In this regard, FIG. 8 illustrates a line that satisfies the start-up performance satisfying the fixing property at an end portion and an allowable line for temperature rise in the non-sheet-passing portion, which were obtained by experiments. In FIG. 8, a horizontal axis represents a thermal resistance X [K/W] in the thickness direction of the thermal-resistant sheet 100, and a vertical axis represents a logarithm Y [log 10 (J/K·m$^2$)] of the heat capacity per unit area in the plane direction of the thermal conductive member 51.

As illustrated in FIG. 8, as a result of experiments, it has turned out that it is necessary to set the logarithm Y [log 10 (J/K·m$^2$)] of the heat capacity per unit area in the plane direction of the thermal conductive member 51 to be greater than 2.55X+2.6 so as to obtain a required start-up performance. This is considered to be because when the heat capacity of the thermal conductive member 51 with respect to the thermal resistance of the thermal-resistant sheet 100 is higher than the allowable line of the start-up performance, heat generated from the heater 37 is easily lost to the thermal conductive member 51 and thus the start-up performance is not satisfied. On the other hand, it has turned out that the non-sheet-passing portion temperature rise can be sufficiently suppressed by setting the logarithm Y [log 10 (J/K·m$^2$)] of the heat capacity per unit area in the plane direction of the thermal conductive member 51 to be less than 0.09X+2.85. This is considered to be because when the heat capacity of the thermal conductive member 51 with respect to the thermal resistance of the thermal-resistant sheet 100 is lower than the allowable line for temperature rise in the non-sheet-passing portion, the effect of suppressing the non-sheet-passing portion temperature rise due to heat transport of the thermal conductive member 51 cannot be obtained and thus the non-sheet-passing portion temperature rise cannot be sufficiently suppressed. Accordingly, it has turned out that, in order to satisfy the start-up performance and the non-sheet-passing portion temperature rise performance, it is necessary for the heat capacity per unit area in the plane direction of the conductive member 51 with respect to the thermal resistance of the thermal-resistant sheet 100 to satisfy the following condition.

$$0.09X+2.85<Y<2.55X+2.6[\log 10\ (J/K\cdot m^2)] \quad (A)$$

In expression (A), the thermal resistance is set to be greater than 2.0 [K/W] so that X [K/W] is set in a range in which no failure occurs due to the non-sheet-passing portion temperature rise, and the thermal resistance is set to be less than 12.5 [K/W] so that X [K/W] is set in a range that does not exceed the upper limit of the start-up time.

Table 2 illustrates a list of measurement results of the start-up time and the non-sheet-passing portion temperature rise when the material and the thermal conductivity of the thermal-resistant sheet 100 are varied. As the thermal-resistant sheet 100, not only Kapton®, but also UPILEX® (UBE INDUSTRIES, LTD.) and a mixture of polyimide and thermal conductive filler such as boron nitride carbon fiber were used. UPILEX® includes polyimide as the main material, just as in the case of Kapton®, and has a thermal conductivity of 0.29 [W/mK]. A mixture of polyimide and thermal conductive filler such as boron nitride carbon fiber, in which the amount of thermal conductive filler was adjusted as needed and the thermal conductivity was 2.0 [W/mK], was used. The measurement was carried out at the same thermal resistance by changing the thickness of the thermal-resistant sheet 100. Each thermal-resistance sheet 100 was evaluated by using 3-mm pure aluminum as the thermal conductive member 51 and by setting the thermal conductivity to 237 [W/mK] and the heat capacity to 3.86 [log 10 (J/K·m$^2$)]. When the thermal-resistant sheets 100 have the same thermal resistance, the values of the start-up time and the non-sheet-passing portion temperature rise were the same even when a heat-insulating member other than Kapton® was used, and the same advantageous effects as those of the present example embodiment were obtained.

TABLE 2

| Heat-insulating sheet 100 | | | | Measurement results | | |
|---|---|---|---|---|---|---|
| Material | Thermal conductivity [W/mK] | Thickness [mm] | Thermal resistance [K/W] | Start-up time [s] | Non-sheet-passing portion temperature rise [° C.] | Determination |
| Kapton | 0.16 | 0.15 | 7.3 | 5.7 | 220 | Effective |
| UPILEX | 0.29 | 0.3 | 7.3 | 5.7 | 220 | |
| PI + boron nitride filler | 2 | 2 | 7.3 | 5.7 | 220 | |

Next, Table 3 illustrates a list of measurement results of the start-up time and the non-sheet-passing portion temperature rise when iron and copper, which is metal other than pure aluminum, are used as metal materials of the thermal conductive member 51. Iron has a thermal conductivity of 80 [W/mK], and the specific heat and the density of iron are 0.442 [kJ/kgK] and 7870 [kg/m$^3$], respectively. Copper has a thermal conductivity of 398 [W/mK], and the specific heat and the density of copper are 0.386 [kJ/kgK] and 8880 [kg/m$^3$], respectively. Accordingly, in the present example embodiment, the measurement was carried out at the same heat capacity by changing the thickness of the thermal conductive member 51. The thermal conductive member 51 was evaluated by using Kapton® with a thickness of 150 [μm] as the thermal-resistant sheet 100 and by setting the thermal conductivity to 0.16 [W/mK] and the thermal resistance to 7.3 [K/W].

At the same heat capacity of the thermal conductive member 51, the values of the start-up time and the non-sheet-passing portion temperature rise were the same even when metal other than pure aluminum was used, and the same advantageous effects as those of the present example embodiment were obtained.

TABLE 3

| Thermal conductive member 51 | | | | Measurement results | | |
|---|---|---|---|---|---|---|
| Material | Thermal conductivity [W/mK] | Thickness [mm] | Heat capacity [log10 (J/K · m$^2$)] | Start-up time [s] | Non-sheet-passing portion temperature rise [° C.] | Determination |
| pure aluminum | 237 | 3 | 3.86 | 5.7 | 220 | Effective |
| iron | 80 | 1.5 | 3.84 | 5.7 | 220 | |
| copper | 398 | 2 | 3.84 | 5.7 | 220 | |

The present example embodiment has been described above using the thermal-resistant sheet 100 including polyimide as the main material. However, as the thermal-resistant sheet 100, a material having a low thermal conductivity and a high thermal resistance, such as PFA, PTFE, or FEP can be used.

While the present example embodiment has been described above using pure aluminum, iron, and copper as the material of the thermal conductive member 51, the material is not limited to metal as described above. As long as the heat capacity falls within the range indicated by the expression (A), other metals having a high thermal conductivity and a high heat capacity, such as gold, silver, nickel, and brass, can also be used. As long as the heat capacity falls within the range indicated by the expression (A), the same advantageous effects as those described above can be obtained by using a material other than metal, such as silicone rubber or carbon graphite.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-088842, filed May 2, 2018, which is hereby incorporated by reference herein in its entirety.

What is claimed is:

1. A fixing apparatus for fixing a toner image formed on a recording material to the recording material, the fixing apparatus comprising:

a rotatable cylindrical film;

a heater including a heat generating resistor formed on a substrate, the heater having a first surface in contact with an inner peripheral surface of the film and a second surface disposed on an opposite side of the first surface;

a support member configured to support the heater;

a pressure member configured to form a nip with the heater through the film to heat the toner image and fix the toner image onto the recording material at the nip;

a thermal conductive member having a thermal conductivity higher than the thermal conductivity of the substrate, the thermal conductive member being disposed above the second surface; and a thermal-resistant member disposed between the thermal conductive member and the substrate, a thermal resistance in a thickness direction of the thermal-resistant member being higher than the thermal resistance in the thickness direction of the thermal conductive member, wherein the thermal conductivity in the thickness direction of the thermal-resistant member is less than or equal to 2 [W/mK].

2. The fixing apparatus according to claim 1, wherein the thermal conductivity of the thermal-resistant member is lower than the thermal conductivity of the thermal conductive member.

3. The fixing apparatus according to claim 1, wherein a heat capacity in a plane direction orthogonal to the thickness direction of the thermal conductive member is greater than the heat capacity in the plane direction orthogonal to the thickness direction of the thermal-resistant member.

4. The fixing apparatus according to claim 1, wherein the thermal-resistant member comprises polyimide as a main material.

5. The fixing apparatus according to claim 1, wherein the thermal conductivity in the thickness direction of the thermal conductive member is greater than or equal to 80 [W/mK].

6. The fixing apparatus according to claim 1, wherein the thermal conductive member comprises metal as a main material.

7. The fixing apparatus according to claim 1, wherein a thermal resistance X in the thickness direction of the thermal-resistant member is greater than 2.0 [K/W] and less than 12.5 [K/W].

8. The fixing apparatus according to claim 7, wherein the following condition is satisfied:

$0.09X+2.85<Y<2.55X+2.6$ [log 10 (J/K·m2)], where Y [log 10 (J/K·m2)] represents a logarithm of a heat capacity per unit area on a surface of the thermal conductive member that is in contact with the heater.

9. The fixing apparatus according to claim 5, wherein the thermal conductive member is made of material at least one of iron, copper, gold, silver, nickel, brass, silicone rubber, and carbon graphite.

10. A fixing apparatus for fixing a toner image formed on a recording material to the recording material, the fixing apparatus comprising:

a rotatable cylindrical film;

a heater including a substrate made of a ceramic material, a heat generating resistor formed on the substrate, and a glass coat layer covering the heat generating resistor, the heater having a first surface which is a surface of the glass coat layer in contact with an inner peripheral surface of the film and a second surface disposed on an opposite side of the first surface;

a support member configured to support the heater;

a pressure member configured to form a nip with the heater through the film to heat the toner image and fix the toner image onto the recording material at the nip;

a thermal conductive member having a thermal conductivity higher than the thermal conductivity of the substrate, the thermal conductive member being disposed above the second surface; and a thermal-resistant member disposed between the thermal conductive member and the substrate, a thermal resistance in a thickness direction of the thermal-resistant member being higher than the thermal resistance in the thickness direction of the thermal conductive member.

11. The fixing apparatus according to claim 10, wherein the thermal conductivity of the thermal-resistant member is lower than the thermal conductivity of the thermal conductive member.

12. The fixing apparatus according to claim 10, wherein a heat capacity in a plane direction orthogonal to the thickness direction of the thermal conductive member is greater than the heat capacity in the plane direction orthogonal to the thickness direction of the thermal-resistant member.

13. The fixing apparatus according to claim 12, wherein the thermal-resistant member is made of material at least one of perfluoroalkoxy alkane (PFA), polytetrafluoroethylene (PTFE), and tetrafluoroethylene-hexafluoropropylene copolymer (FEP).

14. The fixing apparatus according to claim 10, wherein the thermal conductivity in the thickness direction of the thermal-resistant member is less than or equal to 2 [W/mK].

15. The fixing apparatus according to claim 14, wherein the thermal-resistant member is made of material at least one of polyimide, perfluoroalkoxy alkane (PFA), polytetrafluoroethylene (PTFE), and tetrafluoroethylene-hexafluoropropylene copolymer (FEP), as a main material.

16. The fixing apparatus according to claim 10, wherein the thermal conductivity in the thickness direction of the thermal conductive member is greater than or equal to 80 [W/mK].

17. The fixing apparatus according to claim 16, wherein the thermal conductive member is made of material at least one of iron, copper, gold, silver, nickel, brass, silicone rubber, and carbon graphite.

18. The fixing apparatus according to claim 10, wherein a thermal resistance X in the thickness direction of the thermal-resistant member is greater than 2.0 [K/W] and less than 12.5 [K/W].

19. The fixing apparatus according to claim 18, wherein the following condition is satisfied:

$0.09X+2.85<Y<2.55X+2.6$ [log 10 (J/K·m2)], and where Y [log 10 (J/K·m2)] represents a logarithm of a heat capacity per unit area on a surface of the thermal conductive member that is in contact with the heater.

* * * * *